US011597202B2

(12) United States Patent
Ozaki et al.

(10) Patent No.: US 11,597,202 B2
(45) Date of Patent: Mar. 7, 2023

(54) CONTROL CIRCUIT AND INKJET HEAD

(71) Applicant: TOSHIBA TEC KABUSHIKI KAISHA, Tokyo (JP)

(72) Inventors: Kei Ozaki, Sunto Shizuoka (JP); Shunichi Ono, Izu Shizuoka (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 33 days.

(21) Appl. No.: 17/172,978

(22) Filed: Feb. 10, 2021

(65) Prior Publication Data

US 2021/0387451 A1 Dec. 16, 2021

(30) Foreign Application Priority Data

Jun. 11, 2020 (JP) ..... JP2020-101534

(51) Int. Cl.
*B41J 29/38* (2006.01)
*B41J 2/045* (2006.01)

(52) U.S. Cl.
CPC ..... *B41J 2/04541* (2013.01); *B41J 2/04588* (2013.01)

(58) Field of Classification Search
CPC ..... B41J 2/2128; B41J 2/2132; B41J 2/0458; B41J 2/04541
See application file for complete search history.

(56) References Cited

U.S. PATENT DOCUMENTS 7,959,246 B2 6/2011 Hamasaki et al.
2002/0021316 A1* 2/2002 Nakayama ..... B41J 2/0458 347/43
2019/0351676 A1 11/2019 Ito

FOREIGN PATENT DOCUMENTS

JP 2016028882 A 3/2016

OTHER PUBLICATIONS

Extended European Search Report dated Oct. 11, 2021, mailed in counterpart European Application No. 21163373.0, 5 pages.

* cited by examiner

*Primary Examiner* — Lam S Nguyen
(74) *Attorney, Agent, or Firm* — Kim & Stewart LLP

(57) ABSTRACT

According to one embodiment, a control circuit for an inkjet head or the like includes an input circuit configured to receive drive information for driving liquid ejection from a plurality of nozzle arrays. The drive information includes a drive signal value to be supplied to a channel of the plurality of nozzle arrays. A latch circuit array of the control circuit has latch circuits for storing the drive information for each array in the plurality of nozzle arrays. A setting register is configured to receive a setting value to configure the input circuit to correspond to a connection mode for the plurality of latch circuits. The setting value corresponds to the number of arrays in the plurality of nozzle arrays.

17 Claims, 13 Drawing Sheets

CONTROL CIRCUIT AND INKJET HEAD

CROSS-REFERENCE TO RELATED APPLICATION

This application is based upon and claims the benefit of priority from Japanese Patent Application No. 2020-101534, filed on Jun. 11, 2020 the entire contents of which are incorporated herein by reference.

FIELD

Embodiments described herein relate generally to a control circuit and an inkjet head.

BACKGROUND

A liquid discharge head can include nozzle arrays that discharge ink or the like. In such a liquid discharge head, generally, a control circuit (also referred to as a head drive circuit) sequentially transmits print data corresponding to an image to printed to each nozzle array via an internal shift register. The shift register is configured to store the print data for each nozzle array.

In related art, it is required to change the configuration of the control circuit if the number of nozzle arrays to be included in a liquid discharge head design changes. It would be desirable to provide a control circuit that can accommodate designs with different number of nozzles arrays.

DETAILED DESCRIPTION

In general, according to one embodiment, a control circuit for an inkjet head includes an input circuit configured to receive drive information for driving liquid ejection from a plurality of nozzle arrays. The drive information includes a drive signal value to be supplied to a channel of the plurality of nozzle array. A latch circuit array of the control circuit comprises a plurality of latch circuits for storing the drive information for each array in the plurality of nozzle arrays. A setting register is configured to receive a setting value to configure the input circuit to correspond to a connection mode for the plurality of latch circuits. The setting value corresponds to the number of arrays in the plurality of nozzle arrays.

Hereinafter, a printer according to an embodiment will be described with reference to the drawings.

A printer according to an example embodiment forms an image on media (such as paper) by using an inkjet head. The printer discharges ink from the inkjet head to form an image on the medium. The medium on which the printer forms the image is not limited to a specific type. The ink is discharged via a pressure chamber in the inkjet head in the example embodiment. In general, example embodiments can be an office printer, a bar code printer, a point-of-sale (POS) receipt printer, an industrial printer, a 3D printer or other type printer or liquid discharging head or the like. The inkjet head provided in a printer according to the embodiment is one non-limiting example of a liquid discharge head, and the ink is one non-limiting example of a liquid.

Figure 1:
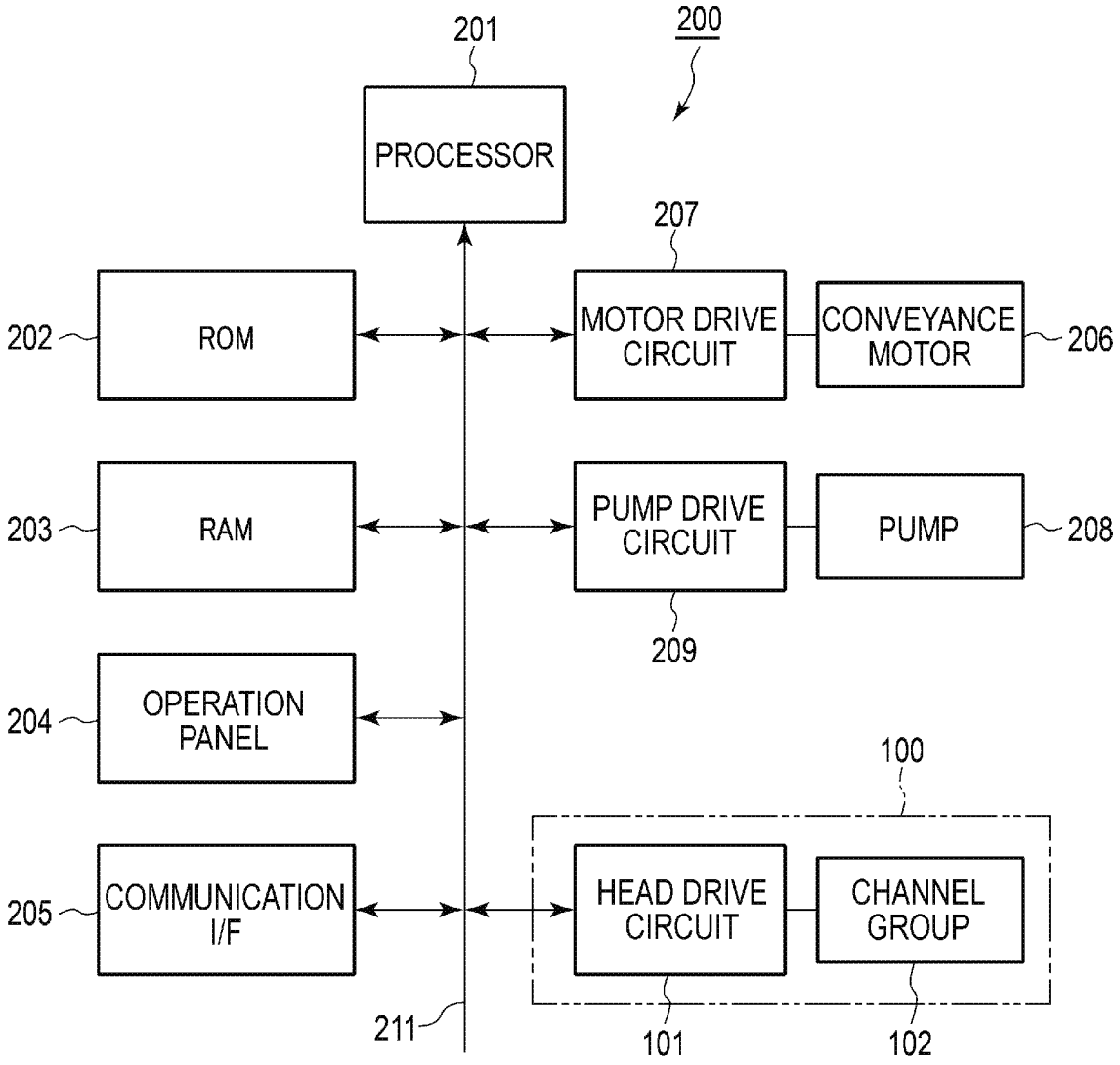
FIG. 1 is a block diagram of a printer according to an embodiment.

FIG. 1 is a block diagram illustrating a configuration example of a printer 200.

As illustrated in FIG. 1, the printer 200 includes a processor 201, a ROM 202, a RAM 203, an operation panel 204, a communication interface 205, a conveyance motor 206, a motor drive circuit 207, a pump 208, a pump drive circuit 209, and an inkjet head 100. The inkjet head 100 includes a head drive circuit 101 and a channel group 102.

The printer 200 includes a bus line 211. The processor 201 can be directly connected to the ROM 202, the RAM 203, the operation panel 204, the communication interface 205, the motor drive circuit 207, the pump drive circuit 209, and the head drive circuit 101 via the bus line 211, or otherwise connected thereto via an input and output (I/O) circuit. The motor drive circuit 207 is connected to the conveyance motor 206. The pump drive circuit 209 is connected to the pump 208. The head drive circuit 101 is connected to the channel group 102.

In addition to the aspects illustrated in FIG. 1, the printer 200 may further include other components, or in some variants, certain depicted component/aspects may be omitted from the printer 200.

The processor 201 controls overall operations of the printer 200. The processor 201 may include an internal cache and various interfaces. The processor 201 realizes various processing operations or functions by executing a program stored in internal cache, the ROM 202, or the like. In some instances, the processor 201 can realize various functions of the printer 200 in conjunction with an operating system and/or an application program.

In some examples, some functions presently described as being realized by executing a software program on the processor 201 may be realized by a dedicated hardware circuit or the like integrated in or with the processor 201. In such cases, the processor 201 provides the described function(s) via the dedicated hardware circuit or the like.

The ROM 202 is a non-volatile memory in which a control program and control data can be stored in advance. Typically, the control program and the control data stored in the ROM 202 are incorporated in advance according to design (manufacturing) specifications of the printer 200. For example, the ROM 202 stores an operating system and an application program for performing printing functions and the like.

The RAM 203 is a volatile memory. The RAM 203 temporarily stores data being processed by the processor 201. The RAM 203 can store various application programs (or portions thereof) that may be loaded based upon an instruction from the processor 201. The RAM 203 can be used to store data necessary for executing an application program as well as output data or the like generated or otherwise supplied by an application program. The RAM 203 may also function as an image data memory on which print data can be loaded.

The operation panel 204 is a user interface that receives inputs of instructions from an operator (user) and displays various information to the operator. The operation panel 204 in this example includes an input operation unit that receives the user input of instructions and a display unit that displays the information.

The operation panel 204 transmits a signal value to the processor 201. The signal value corresponds to an input operation received from the operator via the input operation unit. For example, the input operation unit includes various function keys or buttons, such as a power key, a paper feed key, and an error release key.

The operation panel 204 displays various information on the display unit under the control of the processor 201. For example, the operation panel 204 displays information indicating a present state of the printer 200. For example, the display unit is formed of a liquid crystal monitor.

In some examples, the input operation unit may be or incorporate a touch panel. In such cases, the display unit may be integrated with the touch panel.

The communication interface 205 is for transmitting and receiving data to and from an external device via a network, such as a local area network (LAN). For example, the communication interface 205 supports a LAN connection. For example, the communication interface 205 receives print data from a client terminal via the network. For example, if an error occurs in the printer 200, the communication interface 205 transmits a signal notifying the error to the client terminal.

The motor drive circuit 207 controls the driving of the conveyance motor 206 according to signal values from the processor 201. For example, the motor drive circuit 207 transmits power for driving the conveyance motor or otherwise transmits a control signal to the conveyance motor 206 for driving the conveyance motor 206.

The conveyance motor 206 drives a conveyance mechanism that causes the medium (e.g., paper based) to be moved/conveyed in the printer 200. The conveyance motor 206 is under the control of the motor drive circuit 207. When the conveyance motor 206 is driven, the conveyance mechanism conveys the medium. For example, the conveyance mechanism conveys the medium to a print position at which the inkjet head 100 can print an image of the medium. The conveyance mechanism also operates to discharge the printed medium from a discharge port or the like of the printer 200 to the outside of the printer 200 or the like.

Together, the motor drive circuit 207 and the conveyance motor 206 form a conveyance unit that conveys the medium within the printer 200.

The pump drive circuit 209 controls the driving of the pump 208.

The pump 208 supplies ink from an ink tank to the inkjet head 100.

The inkjet head 100 discharges an ink droplet to the medium based upon the print data. The inkjet head 100 includes the head drive circuit 101 and the channel group 102.

An inkjet head according to an example embodiment will be described with reference to the drawings. In the embodiment, an inkjet head 100 of a shear mode type (refer to FIG. 2) is described. The inkjet head 100 of the example discharges ink on to paper. The medium to which the inkjet head 100 discharges the ink is not limited to any particular type.

Figure 3:
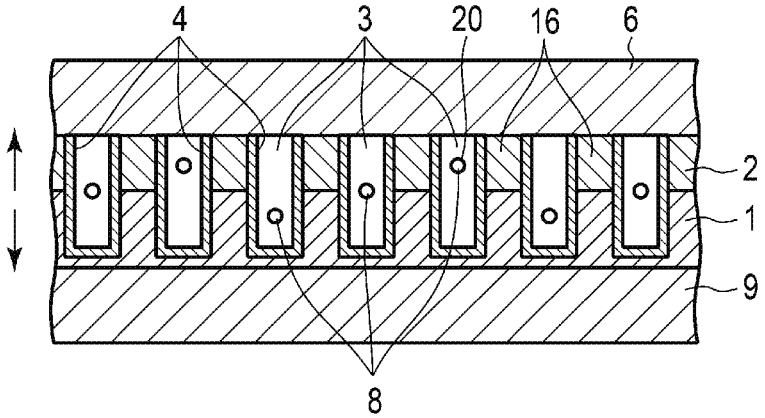
FIG. 3 is a cross-sectional view of an inkjet head according to an embodiment.
Figure 4:
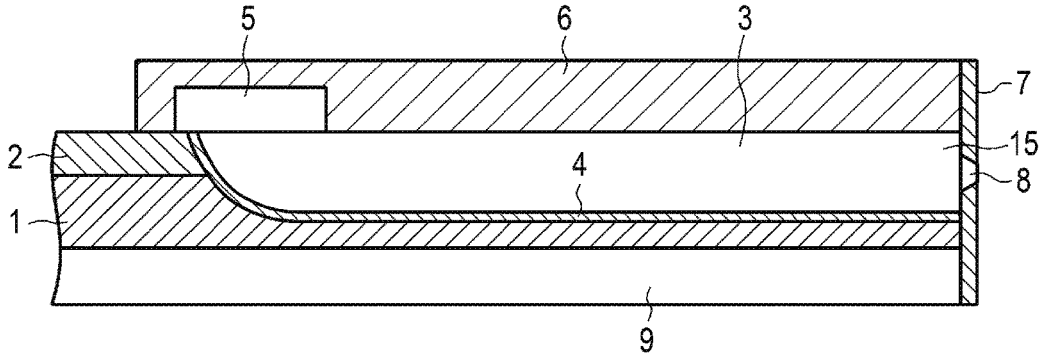
FIG. 4 is a longitudinal cross-sectional view of an inkjet head according to an embodiment.

Next, a configuration example of an inkjet head 100 will be described with reference to FIGS. 2 to 4.

Figure 2:
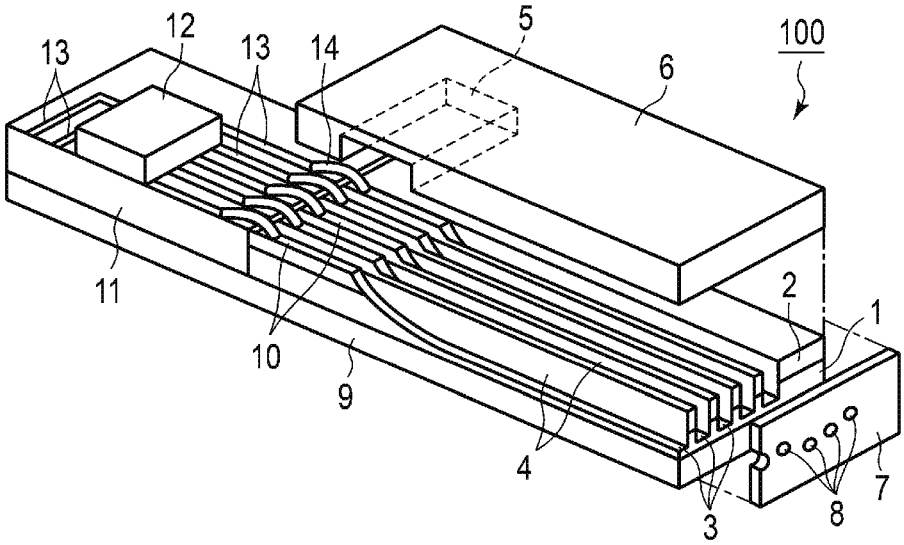
FIG. 2 illustrates a perspective view of an inkjet head according to an embodiment.

FIG. 2 is a perspective view illustrating parts of the inkjet head 100 in an exploded manner. FIG. 3 is a cross-sectional view of the inkjet head 100. FIG. 4 is a longitudinal cross-sectional view of the inkjet head 100.

The inkjet head 100 includes a base substrate 9. A first piezoelectric member 1 is joined to an upper surface of the base substrate 9, and a second piezoelectric member 2 is joined on top of the first piezoelectric member 1. The first piezoelectric member 1 and the second piezoelectric member 2, which are laminated to each other, are polarizable in directions opposite to each other in the plate thickness direction as illustrated by arrows in FIG. 3.

The base substrate 9 is formed of a material having a small dielectric constant. There is also only a small difference in a thermal expansion coefficient between the base substrate 9 and the first piezoelectric member 1/the second piezoelectric member 2. As the material of the base substrate 9, for example, alumina (Al2O3), silicon nitride (Si3N4), silicon carbide (SiC), aluminum nitride (AlN), lead zirconate titanate (PZT) or the like are desirably used. As a material of the first piezoelectric member 1 and the second piezoelectric member 2, lead zirconate titanate (PZT), lithium niobate ($LiNbO_3$), lithium tantalate ($LiTaO_3$) or the like are used.

The inkjet head 100 has a large number of grooves 3. The grooves 3 extend through the joined first piezoelectric member 1 and the second piezoelectric member 2 from a front end to a rear end. Spacing between grooves 3 is uniform and each groove 3 is parallel to the other grooves. The front end of each groove 3 is open, and the rear end thereof is inclined upward.

The inkjet head 100 has electrodes 4 on the side walls and the bottom surface of each groove 3. Each electrode 4 has a two-layer structure of nickel (Ni) and gold (Au). The electrode 4 can be uniformly formed in each groove 3 by, for example, a plating method. The method for forming an electrode 4 is not limited to a plating method. A sputtering method and/or a vapor deposition method can be used instead.

The inkjet head 100 includes extraction electrodes 10 from the rear end of each groove 3 extending toward an upper surface of a rear part of the second piezoelectric member 2. The extraction electrodes 10 extend from the electrodes 4.

The inkjet head 100 includes a top plate 6 and an orifice plate 7. The top plate 6 covers the upper side of each groove 3. The orifice plate 7 covers the front end of each groove 3. A plurality of pressure chambers 15 are formed in the inkjet head 100 by the respective grooves 3 in conjunction with the top plate 6 and the orifice plate 7. Each pressure chamber 15 can be filled with the ink supplied from an ink tank or the like. Each pressure chamber 15 has a shape with, for example, a depth of 300 μm and a width of 80 μm. The pressure chambers 15 are arranged in parallel to each other at a pitch of 169 μm, for example. The pressure chamber 15 can also be referred to as an ink chamber in some instances.

The top plate 6 includes, formed therein, a common ink chamber 5 at a rear portion thereof. The common ink chamber 5 is on a side of the top plate facing towards the base substrate 9. The orifice plate 7 includes a nozzle 8 at a position opposite to each groove 3. The nozzle 8 is in fluid communication with the opposite groove 3 (more particularly, the pressure chamber 15 formed by the groove 3). The nozzle 8 has a shape which is tapered from the side facing the pressure chamber 15 toward the ink discharge side on the opposite side of the orifice plate 7. In this example, the three adjacent nozzles 8 of each group of three pressure chambers 15 adjacent to each other are defined as one set. In this set of nozzles 8, each nozzle 8 is shifted (offset) from the adjacent nozzle 8 by a fixed amount in the height direction of the groove 3 (which in FIG. 3 corresponds to the vertical page direction).

When the pressure chamber 15 is filled with ink, a meniscus 20 of the ink can be formed at the nozzle 8. The meniscus 20 is formed along an inner wall surface of the nozzle 8.

The first piezoelectric member 1 and the second piezoelectric member 2 forma partition wall of a pressure chamber 15 are sandwiched by the electrodes 4 provided in the adjacent pressure chambers 15. These elements collectively form an actuator 16 for changing the pressure of a pressure chamber 15 by changing a size (volume) of the pressure chamber 15.

In the inkjet head 100, a print substrate 11 on which a conductive pattern 13 is formed is joined to an upper surface of the rear side of the base substrate 9. The inkjet head 100 includes a drive integrated circuit (IC) 12 in which the head drive circuit 101 is incorporated. The drive IC 12 is mounted on the print substrate 11. The drive IC 12 is connected to the conductive pattern 13 of the print substrate 11. The conductive pattern 13 is furthermore joined/connected to each extraction electrode 10 of the inkjet head 100 by wire bonding using a conducting wire 14 (bonding wire) or the like.

Each grouping of a pressure chamber 15 and a corresponding electrode 4 and a nozzle 8 is referred to as a channel. The inkjet head 100 thus includes channels ch.1, ch.2, . . . ch.N equal to the total number N of the grooves 3.

The inkjet head 100 also includes a plurality of nozzle arrays. That is, the inkjet head 100 includes a plurality of arrays of channels respectively including the nozzles 8. The orifice plate 7 includes a plurality of nozzle arrays of the nozzles 8. Each nozzle array is formed of nozzles arranged along a main scanning direction of the inkjet head 100. The respective nozzle arrays are formed at positions separated from each other in a sub-scanning direction of the inkjet head 100.

The nozzles 8 forming a nozzle array are formed at positions in the main scanning direction that do not overlap with the nozzles 8 of another nozzle array. Between the nozzles 8 adjacent to each other in a particular nozzle array, the nozzles 8 forming a different nozzle array are formed at positions shifted in the sub-scanning direction.

In the present example, the inkjet head 100 includes two or four nozzle arrays.

Next, the head drive circuit 101 (also referred to as a control circuit) will be described.

The head drive circuit 101 drives channel group 102 of the inkjet head 100 based upon the print data from the processor 201.

The channel group 102 is formed of a plurality of channels (ch.1, ch.2, . . . ch.N), each channel including a pressure chamber 15, an actuator 16, an electrode 4, and a nozzle 8. The channel group 102 discharges an ink droplet by an operation of a pressure chamber 15 in which the actuator 16 expands and contracts based upon a drive signal value from the head drive circuit 101.

The head drive circuit 101 also discharges ink from each nozzle array. The head drive circuit 101 can discharge ink from a plurality of nozzle arrays at the same time.

Figure 5:
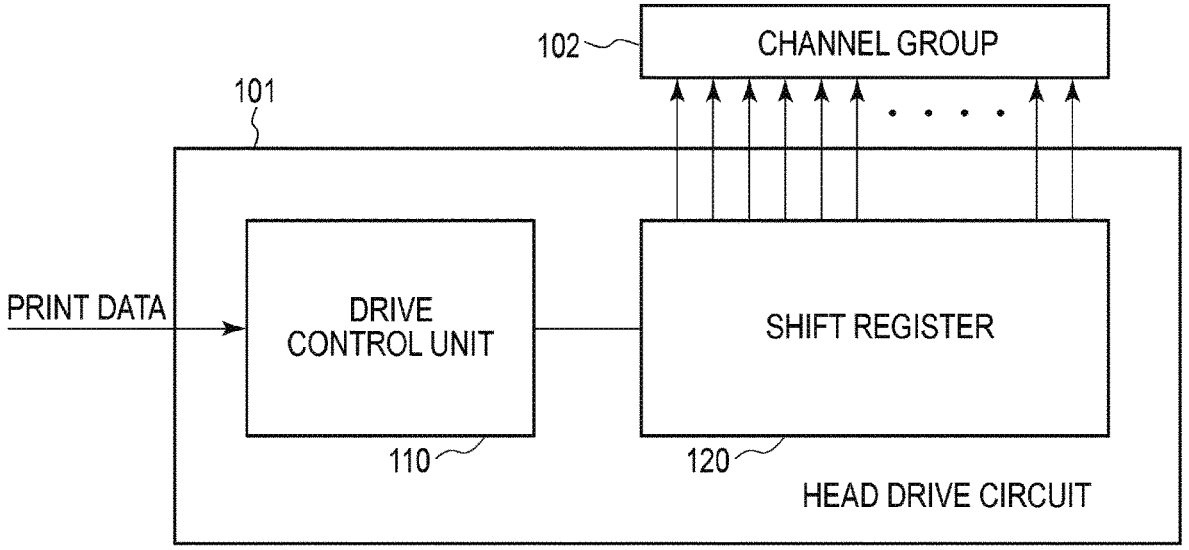
FIG. 5 is a block diagram of a head drive circuit according to an embodiment.

FIG. 5 illustrates a configuration example of the head drive circuit 101. As illustrated in FIG. 5, the head drive circuit 101 includes a drive control unit 110 and a shift register 120. The drive control unit 110 and the shift register 120 are connected to each other via a data bus and/or an interface circuit.

In addition to the configuration illustrated in FIG. 5, a head drive circuit 101 may include other components or aspect, or, in some examples, a depicted component or aspect of the configuration depicted in FIG. 5 may be omitted from the head drive circuit 101.

The drive control unit 110 supplies data to the shift register 120.

The drive control unit 110 receives the print data from the processor 201. The drive control unit 110 generates array data for discharging ink from each nozzle array based upon the print data. The array data is data in which information (drive information) corresponding to the drive signal value to be supplied for each of the nozzles 8 by the head drive circuit 101 is arranged in the order of the corresponding nozzle 8 within each array. For example, the supplied drive information may indicate the number of times ink (e.g., number of droplets) is to be discharged or may otherwise indicate an ink discharge for forming dots on the medium.

The drive control unit 110 generates the array data according to the nozzle arrays particularly provided in the inkjet head 100. That is, the drive control unit 110 provides array data that may be different depending on, for example, the number of nozzle arrays included in the inkjet head 100. The drive control unit 110 sequentially outputs the generated array data to the shift register 120.

For example, if the inkjet head 100 includes two nozzle arrays (referred to in this explanation as an "array A" and an "array B"), the drive control unit 110 generates array data corresponding to the array A (referred to as "array A data") and array data corresponding to the array B (referred to as "array B data"). The drive control unit 110 then sequentially outputs the array A data and the array B data to the shift register 120.

If the inkjet head 100 includes four nozzle arrays (referred to in this explanation as arrays A, B, C, D), the drive control unit 110 generates array data corresponding to the array A ("array A data"), array data corresponding to the array B ("array B data"), array data corresponding to the array C ("array C data"), and array data corresponding to the array D ("array D data"). The drive control unit 110 then sequentially outputs the array A data, array B data, array C data, and array D data to the shift register 120.

The drive control unit 110 can also output a setting signal to the shift register 120 for setting the configuration of the shift register 120. The setting signal sets the configuration of the shift register 120 to match a configuration corresponding to the number of nozzle arrays. The drive control unit 110 transmits the setting signal to the shift register 120 at startup/initialization or the like.

For example, if the inkjet head 100 includes two nozzle arrays, the drive control unit 110 transmits a setting signal with a value (here, "0") for setting the shift register 120 to a two-array mode (an example of a first connection mode).

If the inkjet head 100 includes four nozzle arrays, the drive control unit 110 transmits a setting signal with a value (here, "1") for setting the shift register 120 for a four-array mode (an example of a second connection mode).

The shift register 120 shifts and latches each array data as received from the drive control unit 110. The shift register 120 is connected to each channel.

The head drive circuit 101 supplies a drive signal to each channel based upon the array data stored in the shift register 120. That is, the head drive circuit 101 supplies a drive signal corresponding to the array data to each channel of the nozzle array based upon the predetermined array data.

The head drive circuit 101 supplies the drive signal to each channel by using a level shifter.

Figure 6:
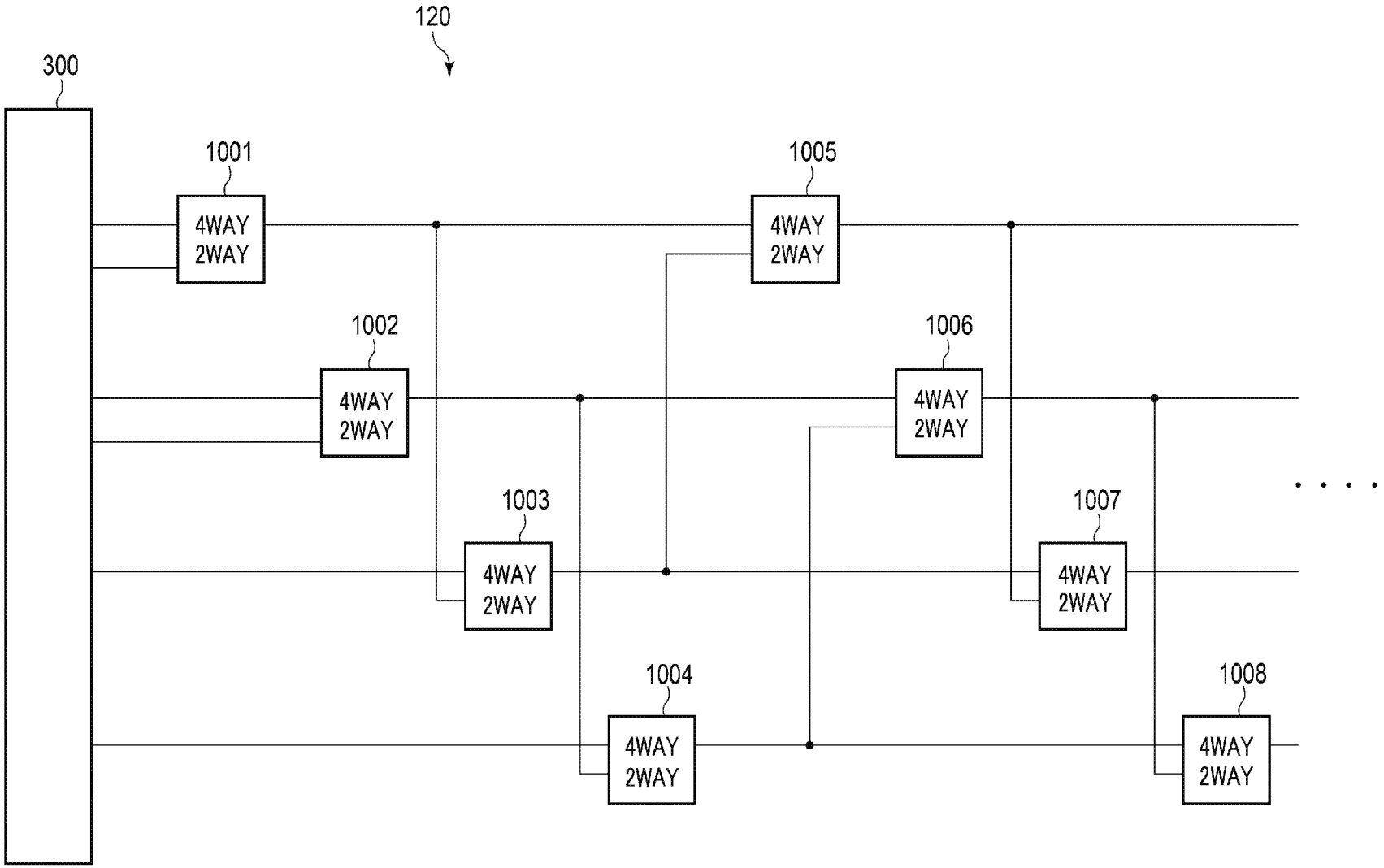
FIG. 6 is a block diagram of a shift register according to an embodiment.

FIG. 6 illustrates a configuration example of the shift register 120. As illustrated in FIG. 6, the shift register 120 includes a distributor 300 and a plurality of latch circuits. In this example, the shift register 120 includes latch circuits 1001 to 1008 (latch circuit 1001, 1002, 1003, 1004, 1005, 1006, 1007, and 1008). This number and arrangement of latch circuits is a representative example and the number and arrangement may be different in other examples.

The distributor 300 receives the array data from the drive control unit 110. The distributor 300 may also be referred to as an input circuit. The distributor 300 outputs the array data to the latch circuits. Here, the distributor 300 is directly connected to the latch circuits 1001 to 1004. The distributor 300 outputs the array data (received from the drive control unit 110) to the latch circuits 1001 to 1004.

The distributor 300 also functions to set the configuration of the shift register 120 according to the value of the setting signal received from the drive control unit 110 (at startup or the like).

The latch circuits 1001 to 1008 each include an input terminal for 4-way ("4WAY") array mode, an input terminal for 2-way ("2WAY") array mode, and a single output terminal. The input terminal for 4-way receives data when the inkjet head 100 includes four nozzle arrays (shift register 120 is operating in the four-array mode). The input terminal for 2-way receives data when the inkjet head 100 includes two nozzle arrays (shift register 120 is operating in the two-array mode).

The latch circuits 1001 to 1008 shift and latch the data received via the input terminal for 4-way mode or the input terminal fort-way mode. The latch circuits 1001 to 1008 respectively shift and latch the drive information supplied thereto.

The latch circuits 1001 to 1008 are respectively connected to respective channels of the channel group 102. Here, the latch circuits 1001 to 1008 correspond to ch.1 to ch.8, respectively. That is, the latch circuits 1001 to 1008 store the drive information for the respective channels (ch.1 to ch.8).

An output terminal of an (n)th latch circuit is selectively connected to the input terminal for 2-way of the (n+2)th latch circuit or the input terminal for 4-way of the (n+4)th latch circuit. Here, the (n)th latch circuit is a latch circuit corresponding to ch.n, where n is an integer of 1 or more.

In the example illustrated in FIG. 6, the output terminal of the latch circuit 1001 can be selectively connected to the 2-way input terminal of the latch circuit 1003 or the 4-way input terminal of the latch circuit 1005. The output terminal of the latch circuit 1002 can be selectively connected to the 2-way input terminal of the latch circuit 1004 or the 4-way input terminal of the latch circuit 1006. The output terminal of the latch circuit 1003 can be selectively connected to the 2-way input terminal of the latch circuit 1005 or the 4-way input terminal for of the latch circuit 1007. The output terminal of the latch circuit 1004 can be selectively connected to the 2-way input terminal of the latch circuit 1006 or the 4-way input terminal of the latch circuit 1008.

Figure 7:
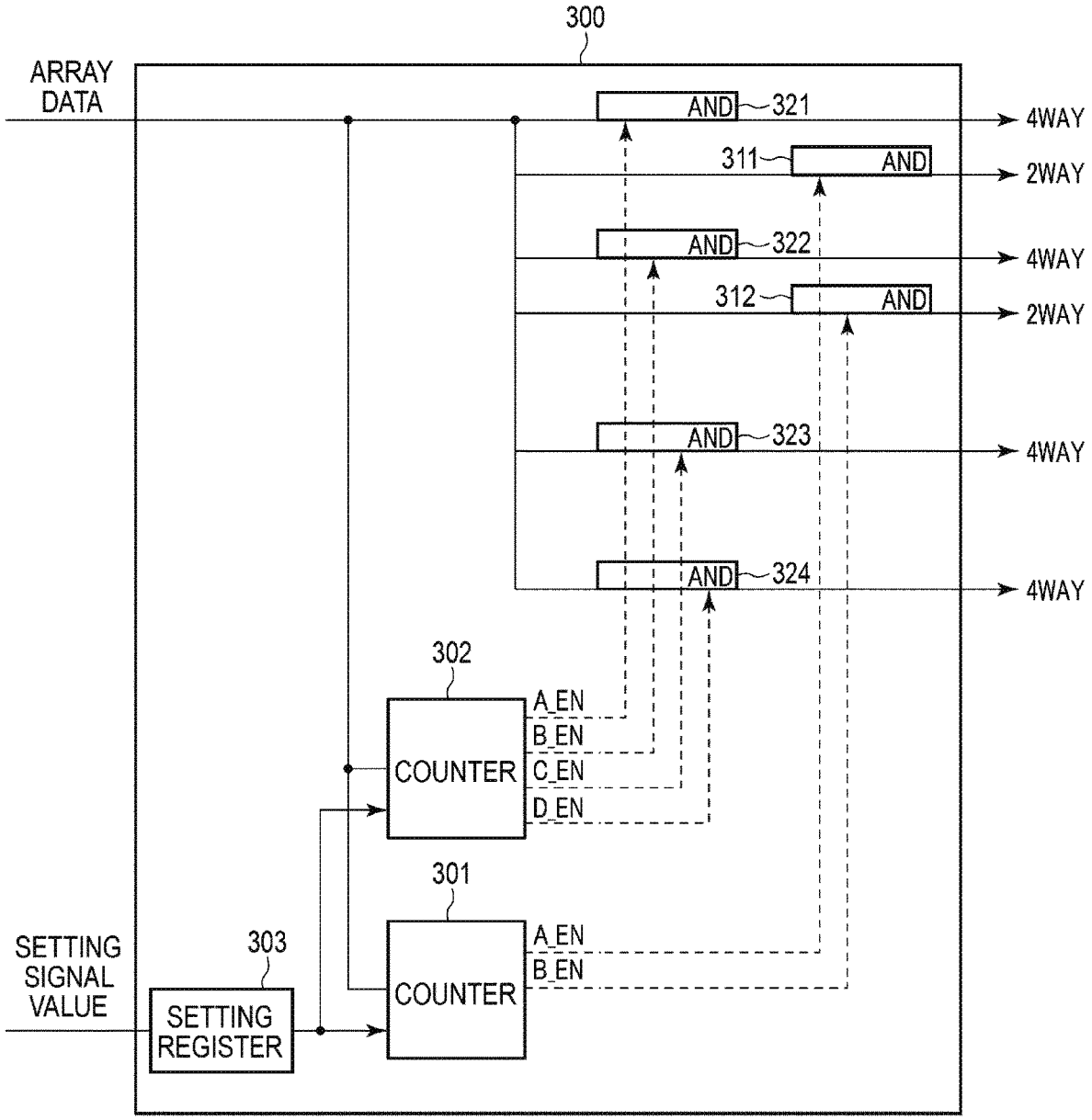
FIG. 7 is a block diagram of a distributor according to an embodiment.

FIG. 7 illustrates a configuration example of the distributor 300. As illustrated in FIG. 7, the distributor 300 includes a counter 301, a counter 302, a setting register 303, AND circuits 311 and 312, and circuits 321, 322, 323, and 324.

The setting register 303 is connected to the counter 301 and the counter 302. The counter 301 is connected to the AND circuit 311 and the AND circuit 312. The counter 302 is connected to the AND circuits 321 to 324.

The setting register 303 receives the setting signal from the drive control unit 110. The setting register 303 stores the setting signal value. For example, the setting register 303 stores the setting signal value for setting a configuration with two nozzle arrays or for setting a configuration with four nozzle arrays.

The setting register 303 outputs the stored value of the setting signal to the counter 301 and the counter 302.

The counter 301 outputs a control signal to the AND circuit 311 and the AND circuit 312.

The counter 301 becomes starts or not based upon the setting signal value stored in the setting register 303. Here, the counter 301 starts counting if the setting signal value is "0". If the counter 301 has not been started in view of the setting signal value, the counter 301 outputs "0" (for example, a "low" signal value) to the AND circuit 311 and the AND circuit 312.

The counter 301 outputs "0" to the AND circuit 311 and the AND circuit 312 in an initial state.

If the counter 301 becomes active (activated), the counter 301 receives the array data from the drive control unit 110. That is, the counter 301 receives continuous drive information as the array data.

The counter 301 can be configured in advance to correspond a possible number of nozzle arrays that might be incorporated in an inkjet head 100 and thus appropriately output array data from the drive control unit 110. Here, the counter 301 has a configuration appropriate for when the inkjet head 100 includes two nozzle arrays.

When receiving the drive information from the drive control unit 110, the counter 301 outputs "1" (for example, a "high" signal value) to the AND circuit 311. The counter 301 counts the received drive information to match array drive information to an appropriate one of the nozzle arrays. The counter 301 outputs "1" to the AND circuit 311 when the drive control unit 110 outputs the array A data.

If "0" is being outputted to the AND circuit 311, the counter 301 outputs "1" to the AND circuit 312 when the drive control unit 110 outputs the array B data. The counter 301 resets the count and starts counting the received drive information again.

The counter 302 outputs a control signal value to each of the AND circuit 321 to the AND circuit 324.

The counter 302 becomes starts based upon the setting signal value stored in the setting register 303. Here, the counter 302 becomes active (activated) if the setting signal value is "1". If the counter 302 is inactive, the counter 302 outputs "0" to the AND circuit 321 to the AND circuit 324.

The counter 302 outputs "0" to the AND circuit 321 to the AND circuit 324 in an initial state.

When the counter 302 becomes active, the counter 302 receives the array data from the drive control unit 110. That is, the counter 302 receives continuous drive information as the array data.

The counter 302 can be configured in advance to correspond to a possible number of nozzle arrays that might be incorporated in an inkjet head 100 and thus appropriately output array data from the drive control unit 110. Here, the counter 302 has a configuration appropriate for when the inkjet head 100 includes four nozzle arrays.

When receiving the drive information from the drive control unit 110, the counter 302 outputs "1" to the AND circuit 321. The counter 302 counts the received drive information to match array drive information to an appropriate one of the nozzle arrays. The counter 302 outputs "1" to the AND circuit 321 while the drive control unit 110 outputs the array A data and "0" otherwise.

The counter 302 outputs "1" to the AND circuit 322 while the drive control unit 110 outputs the array B data and "0" otherwise.

The counter 302 outputs "1" to the AND circuit 323 while the drive control unit 110 outputs the array C data and "0" otherwise.

The counter 302 outputs "1" to the AND circuit 324 while the drive control unit 110 outputs the array D data and "0" otherwise.

The AND circuit 311 receives the array data from the drive control unit 110 and a control signal value ("A_EN") from the counter 301. The AND circuit 311 outputs the received array data to the "2WAY" input terminal of the latch circuit 1001 while "1" is being received from the counter 301. That is, if the inkjet head 100 includes just two nozzle arrays, then the AND circuit 311 operates to output the array A data to the "2WAY" input terminal of the latch circuit 1001.

The AND circuit 312 receives the array data from the drive control unit 110 and a control signal value ("B_EN") from the counter 301. The AND circuit 312 outputs the received array data to the "2WAY" input terminal of the latch circuit 1002 while "1" is being received from the counter 301. That is, if the inkjet head 100 includes just two nozzle arrays, the AND circuit 312 operates to output the array B data to the "2WAY" input terminal of the latch circuit 1002.

The AND circuit 321 receives the array data from the drive control unit 110 and a control signal value ("A_EN") from the counter 302. The AND circuit 321 operates to output the received array data to the "4WAY" input terminal of the latch circuit 1001 while "1" is being received from the counter 302. That is, if the inkjet head 100 includes four nozzle arrays, the AND circuit 321 operates to output the array A data to the "4WAY" input terminal of the latch circuit 1001.

The AND circuit 322 receives the array data from the drive control unit 110 and a control signal value ("B_EN") from the counter 302. The AND circuit 322 operates to output the received array data to the "4WAY" input terminal of the latch circuit 1002 while "1" is being received from the counter 302. That is, if the inkjet head 100 includes four nozzle arrays, the AND circuit 322 operates to output the array B data to the "4WAY" input terminal of the latch circuit 1002.

The AND circuit 323 receives the array data from the drive control unit 110 and a control signal value ("C_EN") from the counter 302. The AND circuit 323 operates to output the received array data to the "4WAY" input terminal of the latch circuit 1003 while "1" is being received from the counter 302. That is, if the inkjet head 100 includes four nozzle arrays, the AND circuit 323 operates to output the array C data to the "4WAY" input terminal of the latch circuit 1003.

The AND circuit 324 receives the array data from the drive control unit 11, and a control signal value ("D_EN") from the counter 302. The AND circuit 324 operates to output the received array data to the "4WAY" input terminal of the latch circuit 1004 while "1" is being received from the counter 302. That is, if the inkjet head 100 includes four nozzle arrays, the AND circuit 324 operates to output the array D data to the "4WAY" input terminal of the latch circuit 1004.

Next, an operation example of the head drive circuit 101 will be described.

First, a case in which the inkjet head 100 includes two nozzle arrays will be described.

Figure 8:
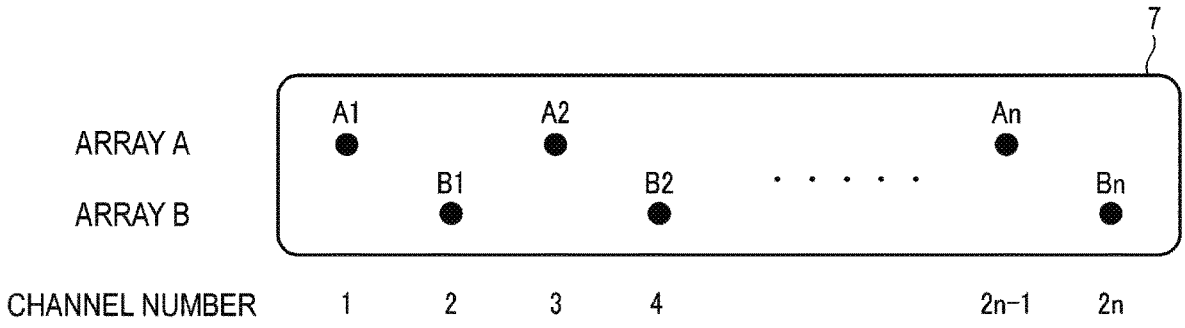
FIG. 8 illustrates aspects of an orifice plate according to an embodiment.

FIG. 8 illustrates an example of the orifice plate 7 including two nozzle arrays. As illustrated in FIG. 8, the orifice plate 7 includes an array A (with nozzles A1, A2 . . . An) and an array B (with nozzles B1, B2 . . . Bn) as the available nozzle arrays. The nozzles 8 in the array A and the nozzles 8 in the array B are alternately arranged.

The respective nozzles 8 (A1, A2 . . . An) in the array A respectively correspond to (2n−1).ch, where n is the index value of the nozzle 8. The respective nozzles 8 in the array A thus respectively correspond to the (2n−1)th latch circuit.

In the same manner, the respective nozzles 8 (B1, B2 . . . Bn) in the array B respectively correspond to 2n.ch. The respective nozzles 8 in the array B thus respectively correspond to the (2n)th latch circuit.

Here, in this case of a two array inkjet head 100, the operator sets the drive control unit 110 so that the setting signal value ("0") for setting the two-array mode is outputted to the shift register 120.

The drive control unit 110 outputs the setting signal value for setting the two-array mode to the shift register 120 at the time of starting (startup/initialization). The setting register 303 of the shift register 120 receives and then stores the setting signal value.

When the setting register 303 stores the setting signal value, the respective latch circuits can be connected to each other to form a configuration corresponding to the two-array mode.

Figure 9:
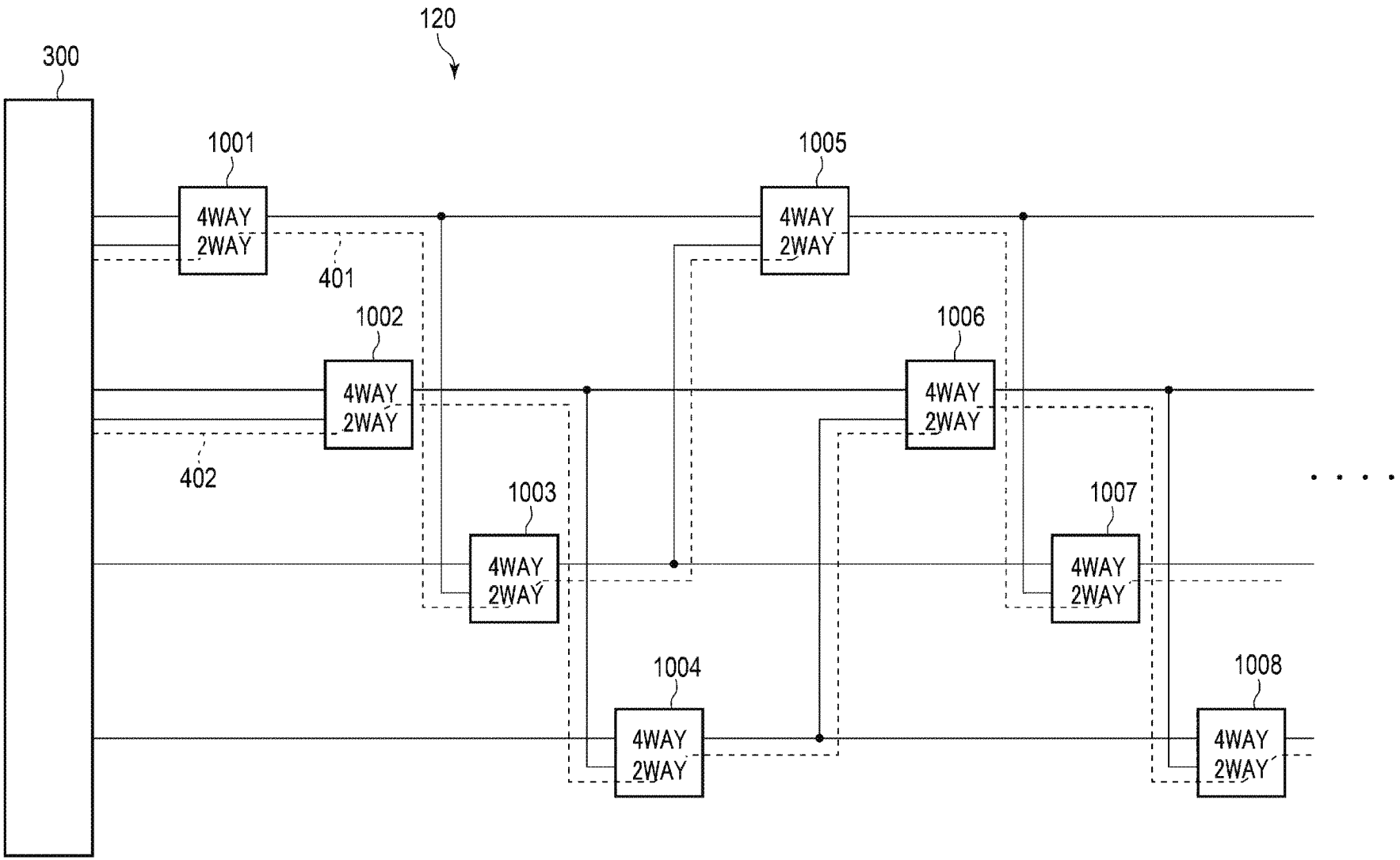
FIG. 9 illustrates aspects of a latch circuit according to an embodiment.

FIG. 9 illustrates a connection relationship of the respective latch circuits when set to the two-array mode. In FIG. 9, the respective latch circuits are connected to each other to form a latch circuit array 401 and a latch circuit array 402. The respective latch circuits are connected to each other via the "2WAY" input terminal.

The latch circuit array 401 connects the latch circuit 1001, the latch circuit 1003, the latch circuit 1005, the latch circuit 1007, and the like sequentially from the distributor 300. That is, the (2n−1)th latch circuits are sequentially connected to each other in ascending order of the index value n. The latch circuit array 401 can store the array A data.

The latch circuit array 402 connects the latch circuit 1002, the latch circuit 1004, the latch circuit 1006, the latch circuit 1008, and the like sequentially from the distributor 300. That is, the (2n)th latch circuits are sequentially connected to each other in ascending order of the index value n. The latch circuit array 402 can store the array B data.

Next, the array data output by the drive control unit 110 and the control signal value output by the counter 301 will be described.

Figure 10:
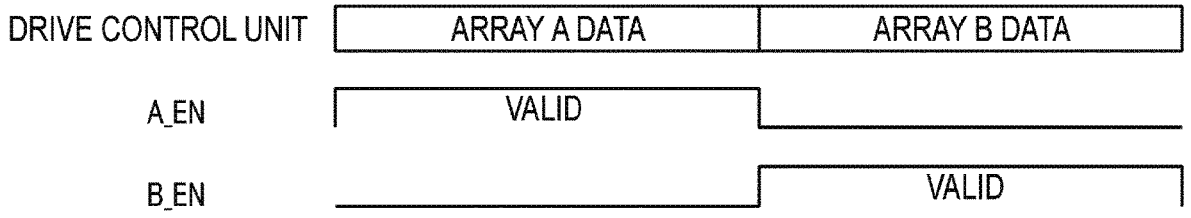
FIG. 10 is a timing chart illustrating a signal value of a shift register.

FIG. 10 is a timing chart illustrating the array data outputted by the drive control unit 110 and the control signal value outputted by the counter 301.

In the present instance, the counter 302 is not active and thus outputs "0".

In FIG. 10, "A_EN" indicates the control signal value output by the counter 301 to the AND circuit 311. "B_EN" indicates the control signal value output by the counter 301 to the AND circuit 312.

As illustrated in FIG. 10, while the drive control unit 110 outputs the array A data, the counter 301 outputs a valid signal ("1" or a high logic value) to the AND circuit 311, and outputs non-valid signal ("0" or a low logic value) to the AND circuit 312. As a result, the AND circuit 311 supplies the array A data from the drive control unit 110 to the latch circuit array 401. That is, the AND circuit 311 supplies the array A data to the latch circuit array corresponding to the array A.

While the drive control unit 110 outputs the array B data, the counter 301 outputs a valid signal ("1") to the AND circuit 312, and outputs a non-valid signal ("0") to the AND circuit 311. As a result, the AND circuit 312 supplies the array B data from the drive control unit 110 to the latch circuit array. That is, the AND circuit 312 supplies the array B data to the latch circuit array corresponding to the array B.

Figure 11:
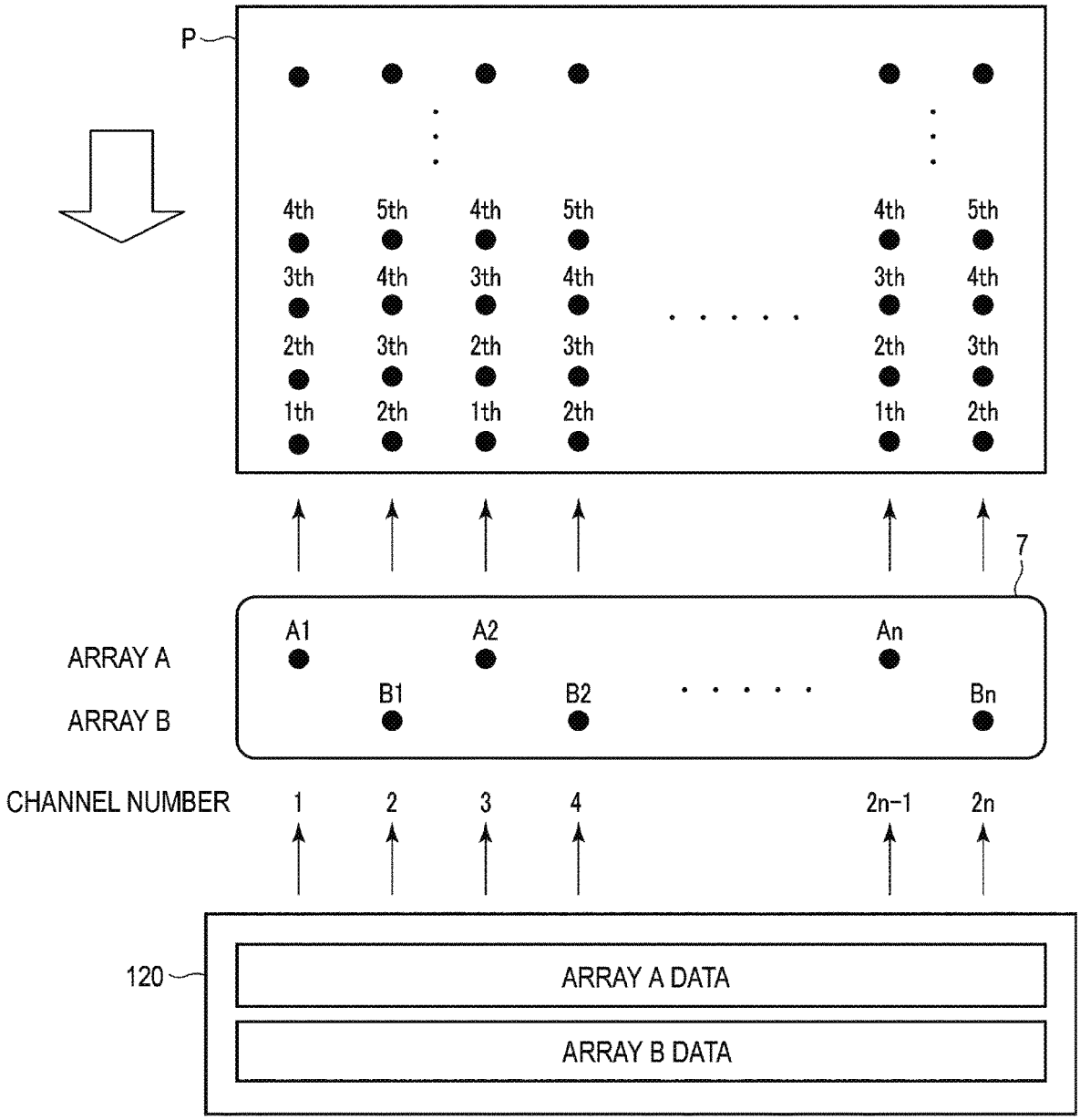
FIG. 11 is a diagram illustrating aspects of an operating example of an inkjet head.

FIG. 11 illustrates an operation example in which the printer 200 prints an image on paper P. As illustrated in FIG. 11, the processor 201 causes the conveyance motor 206 to convey the paper P in the arrow direction (the downward direction in FIG. 11).

When a print area of the paper P reaches the array A, the head drive circuit 101 discharges ink from the nozzles 8 of the array A to the paper P. That is, the head drive circuit 101 outputs the drive signal value to each channel in the array A based upon the drive information stored in the latch circuit array 401. Therefore, dots (labeled "lth" in FIG. 11) formed by ejected ink can be formed on the paper P.

When the print area of the paper P reaches the array B, the head drive circuit 101 discharges ink from the nozzles 8 of the array A and the nozzles 8 of the array B to the paper P. That is, the head drive circuit 101 outputs the drive signal value to each channel in the array A based upon the drive information stored in the latch circuit array 401. The head drive circuit 101 outputs the drive signal value to each channel in the array B based upon the drive information stored in the latch circuit array 402. Therefore, dots (labeled "2th" in FIG. 11) formed by the ejected ink can be formed on the paper P.

After a predetermined time elapses, the head drive circuit 101 again discharges ink from the nozzles 8 of the array A and the nozzles 8 of the array B to the paper P. Therefore, dots (labeled "3th") caused by ejected ink can be formed on the paper P.

In the same manner, the head drive circuit 101 forms dots (4th), dots (5th), and the like on the paper P.

The head drive circuit 101 may at an end of the print area of the paper P discharge ink only from the nozzles 8 of the array B to the paper P.

By the above-described operation, the head drive circuit 101 prints an image on the paper P.

Next, a case in which the inkjet head 100 includes four nozzle arrays will be described.

Figure 12:
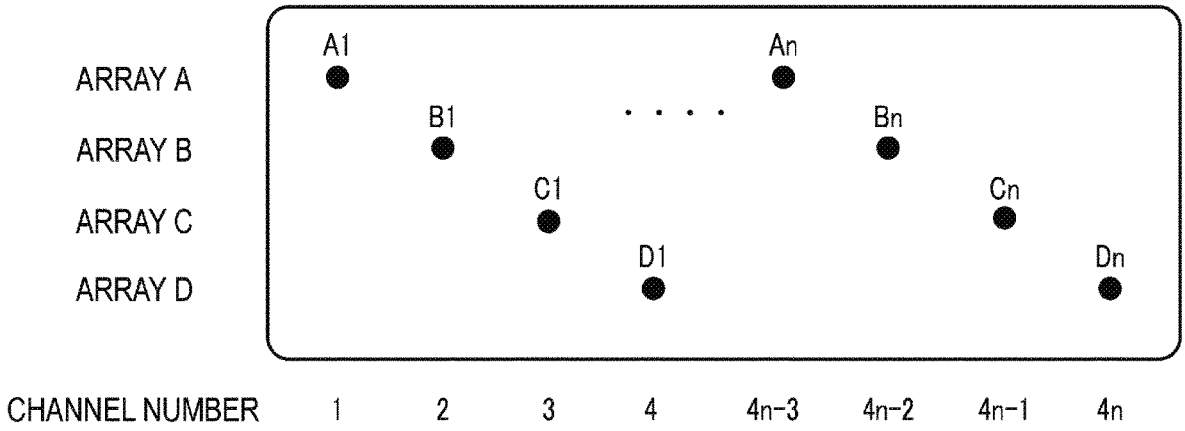
FIG. 12 illustrates aspects of an orifice plate according to an embodiment.

FIG. 12 illustrates an example of the orifice plate 7 including four nozzle arrays. As illustrated in FIG. 12, the orifice plate 7 has an array A, an array B, the array C, and an array D as the available nozzle arrays.

The nozzles 8 in the array A, the nozzles 8 in the array B, the nozzles 8 in the array C, and the nozzles 8 in the array D are arranged shifted from each other in the main scanning direction and the sub-scanning direction.

The respective nozzles 8 in the array A respectively correspond to (4n−3).ch. That is, the respective nozzles 8 in the array A respectively correspond to the (4n−3)th latch circuit.

In the same manner, the respective nozzles 8 in the array B respectively correspond to (4n−2).ch. That is, the respective nozzles 8 in the array B respectively correspond to the (4n−2)th latch circuit.

In the same manner, the respective nozzles 8 in the array C respectively correspond to (4n−1).ch. That is, the respective nozzles 8 in the array C respectively correspond to the (4n−1)th latch circuit.

In the same manner, the respective nozzles 8 in the array D respectively correspond to 4n.ch. That is, the respective nozzles 8 in the array D respectively correspond to the (4n)th latch circuit.

In the present instance, the operator sets the drive control unit 110 so that the setting signal value ("1") for setting the four-array mode is output to the shift register 120.

The drive control unit 110 outputs the setting signal value for setting the four-array mode to the shift register 120 at the time of starting (startup/initialization). The setting register 303 of the shift register 120 receives and then stores the setting signal value.

When the setting register 303 stores the setting signal value, the respective latch circuits can be connected to each other to form a configuration corresponding to the four-array mode.

Figure 13:
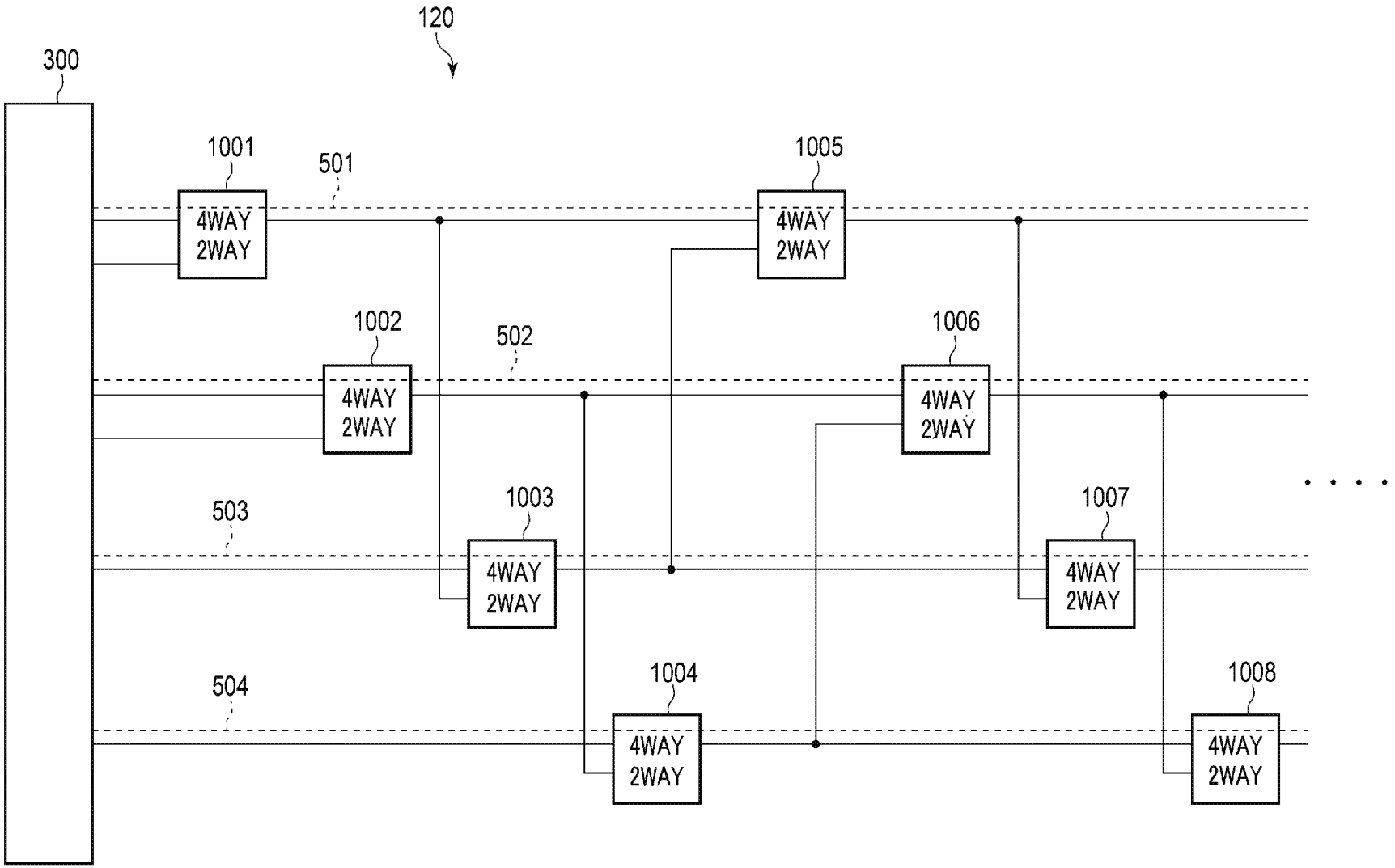
FIG. 13 is a diagram illustrating a connection example of a latch circuit.

FIG. 13 illustrates a connection relationship between the respective latch circuits when set in the four-array mode. In FIG. 13, the respective latch circuits are connected to each other to form latch circuit arrays 501 to 504. The respective latch circuits are connected to each other via the "4WAY" input terminal.

The latch circuit array 501 connects the latch circuit 1001, the latch circuit 1005, and the like sequentially from the distributor 300. That is, the (4n−3)th latch circuits are sequentially connected to each other in ascending order of the index value n. The latch circuit array 501 stores the array A data.

The latch circuit array 502 connects the latch circuit 1002, the latch circuit 1006, and the like sequentially from the distributor 300. That is, the (4n−2)th latch circuits are sequentially connected to each other in ascending order of the index value n. The latch circuit array 502 stores the array B data.

The latch circuit array 503 connects the latch circuit 1003, the latch circuit 1007, and the like sequentially from the distributor 300. That is, the (4n−1)th latch circuits are sequentially connected to each other in ascending order of the index value n. The latch circuit array 503 stores the array C data.

The latch circuit array 504 connects the latch circuit 1004, the latch circuit 1008, and the like sequentially from the distributor 300. That is, the (4n)th latch circuits are sequentially connected to each other in ascending order of the index value n. The latch circuit array 504 stores the array D data.

Next, the array data output by the drive control unit 110 and the control signal value output by the counter 302 will be described.

Figure 14:
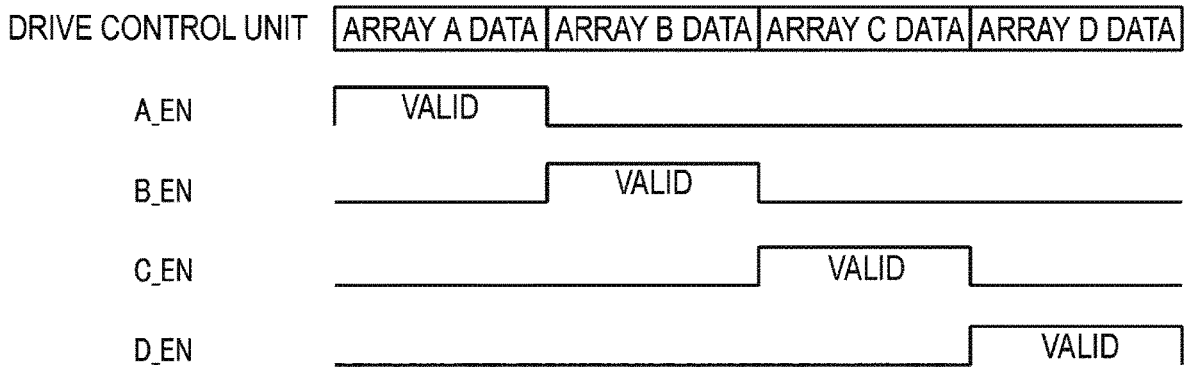
FIG. 14 is a timing chart illustrating a signal value of a shift register.

FIG. 14 is a timing chart illustrating the array data outputted by the drive control unit 110 and the control signal value outputted by the counter 302.

In the present instance, the counter 301 is not active and thus outputs "0".

In FIG. 13, "A_EN" indicates the control signal value output by the counter 302 to the AND circuit 321. "B_EN"

indicates the control signal value output by the counter 302 to the AND circuit 322. "C_EN" indicates the control signal value output by the counter 302 to the AND circuit 323. "D_EN" indicates the control signal value output by the counter 302 to the AND circuit 324.

As illustrated in FIG. 13, while the drive control unit 110 outputs the array A data, the counter 302 outputs a valid signal ("1") to the AND circuit 321, and outputs a non-valid signal ("0") to the AND circuits 322, 323, and 324. As a result, the AND circuit 321 supplies the array A data from the drive control unit 110 to the latch circuit array 501. That is, the AND circuit 321 supplies the array A data to the latch circuit corresponding to the array A.

While the drive control unit 110 outputs the array B data, the counter 302 outputs a valid signal ("1") to the AND circuit 322, and outputs a non-valid signal ("0") to the AND circuits 321, 323, and 324. As a result, the AND circuit 322 supplies the array B data from the drive control unit 110 to the latch circuit array 502. That is, the AND circuit 322 supplies the array B data to the latch circuit corresponding to the array B.

While the drive control unit 110 outputs the array C data, the counter 302 outputs a valid signal ("1") to the AND circuit 323, and outputs a non-valid signal ("0") to the AND circuits 321, 322, and 324. As a result, the AND circuit 323 supplies the array C data from the drive control unit 110 to the latch circuit array 503. That is, the AND circuit 323 supplies the array C data to the latch circuit corresponding to the array C.

While the drive control unit 110 outputs the array D data, the counter 302 outputs a valid signal ("1") to the AND circuit 324, and outputs a non-valid ("0") to the AND circuits 321, 322, and 323. As a result, the AND circuit 324 supplies the array D data from the drive control unit 110 to the latch circuit array 504. That is, the AND circuit 324 supplies the array D data to the latch circuit corresponding to the array D.

Figure 15:
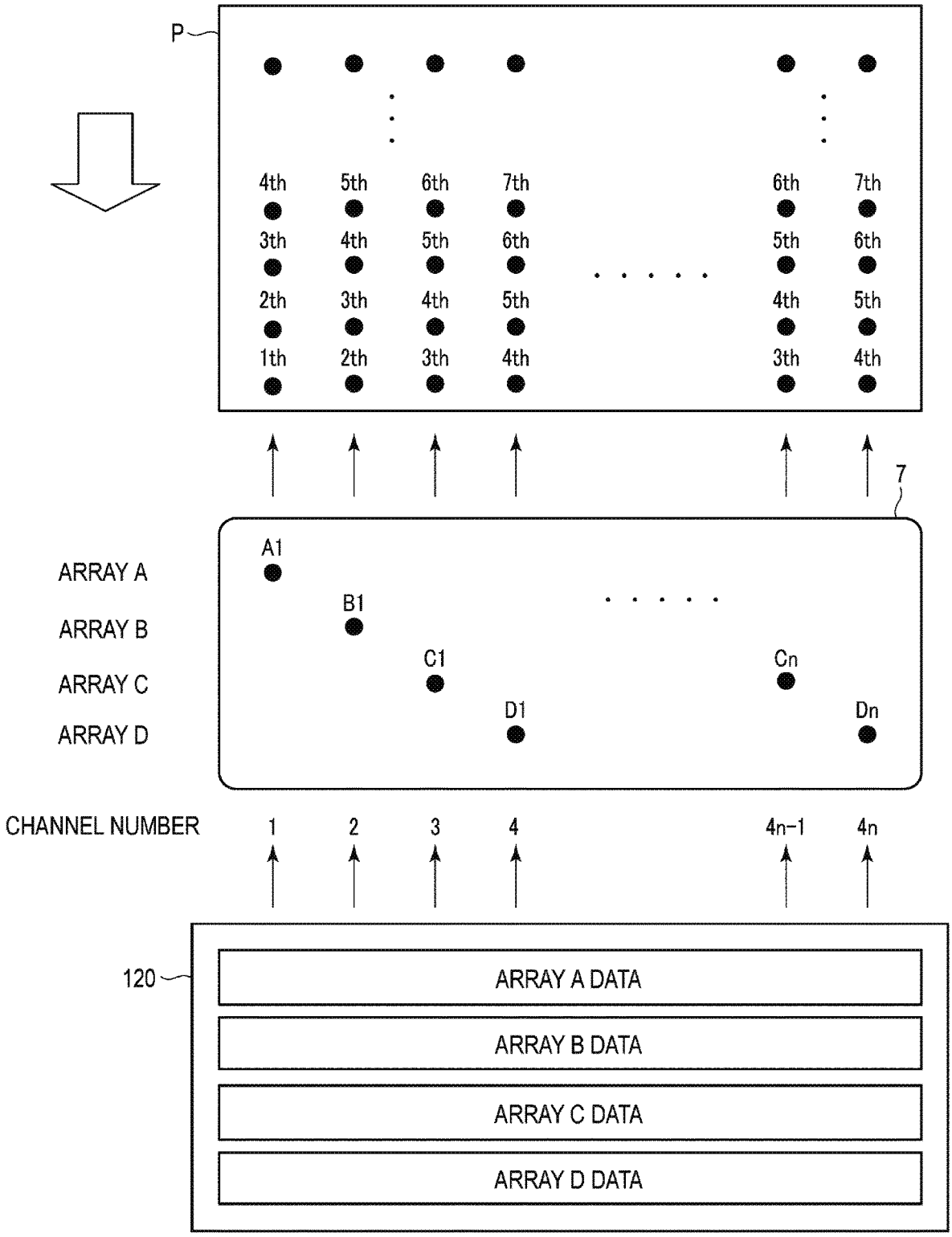
FIG. 15 is a diagram illustrating aspects of an operating example of an inkjet head.

FIG. 15 illustrates an operation example in which the printer 200 prints an image on paper P. As illustrated in FIG. 15, the processor 201 causes the conveyance motor 206 to convey the paper P in the arrow direction (the downward direction in FIG. 15).

When a print area of the paper P reaches the array A, the head drive circuit 101 discharges ink from the nozzles 8 of the array A to the paper P. That is, the head drive circuit 101 outputs the drive signal value to each channel in the array A based upon the drive information stored in the latch circuit array 501. Therefore, dots (labeled "1th" in FIG. 15) formed by ejected ink can be formed on the paper P.

When the print area of the paper P reaches the array B, the head drive circuit 101 discharges ink from the nozzles 8 in the array A and the nozzles 8 in the array B to the paper P. That is, the head drive circuit 101 outputs the drive signal value to each channel in the array A based upon the drive information stored in the latch circuit array 501. The head drive circuit 101 outputs the drive signal value to each channel in the array B based upon the drive information stored in the latch circuit array 502. Therefore, dots (labeled "2th" in FIG. 15) formed by ejected ink can be formed on the paper P.

When the print area of the paper P reaches the array C, the head drive circuit 101 discharges ink from the nozzles 8 in the array A, the nozzles 8 in the array B, and the nozzles 8 in the array C to the paper P. That is, the head drive circuit 101 outputs the drive signal value to each channel in the array A based upon the drive information stored in the latch circuit array 501. The head drive circuit 101 also outputs the drive signal value to each channel in the array B based upon the drive information stored in the latch circuit array 502. The head drive circuit 101 also outputs the drive signal value to each channel in the array C based upon the drive information stored in the latch circuit array 503. Therefore, dots (labeled "3th" in FIG. 15) formed by ejected ink can be formed on the paper P.

When the print area of the paper P reaches the array D, the head drive circuit 101 discharges ink from the nozzles 8 in the array A, the nozzles 8 in the array B, the nozzles 8 in the array C, and the nozzles 8 in the array D to the paper P. That is, the head drive circuit 101 outputs the drive signal value to each channel in the array A based upon the drive information stored in the latch circuit array 501. The head drive circuit 101 also outputs the drive signal value to each channel in the array B based upon the drive information stored in the latch circuit array 502. The head drive circuit 101 also outputs the drive signal value to each channel in the array C based upon the drive information stored in the latch circuit array 503. The head drive circuit 101 also outputs the drive signal value to each channel in the array D based upon the drive information stored in the latch circuit array 504. Therefore, dots (labeled "4th" in FIG. 15) formed by ejected ink can be formed on the paper P.

After a predetermined time elapses, the head drive circuit 101 again discharges ink from the nozzles 8 in the array A, the nozzles 8 in the array B, the nozzles 8 in the array C, and the nozzles 8 in the array D to the paper P. Therefore, dots (labeled "5th" in FIG. 15) formed by ejected ink can be formed on the paper P.

In the same manner, the head drive circuit 101 forms dots (6th), dots (7th), and the like on the paper P.

By the above-described operation, the head drive circuit 101 prints an image on the paper P.

In other examples, the shift register 120 may be provided to correspond to a nozzle array design other than two arrays or four arrays. For example, the shift register 120 may correspond to a nozzle array of six arrays, eight arrays, or more arrays. The latch circuits are connected to each other for each predetermined number of arrays, thereby forming the latch circuit array.

For example, if the inkjet head 100 includes a nozzle array with m total number of different arrays (where m is an integer of 1 or more), the shift register 120 can be provided to respectively and sequentially connects the $(n \times m-m+1)$th latch circuit, the $(n \times m-m+2)$th latch circuit . . . and the $(n \times m)$th latch circuit, thereby forming the latch circuit array as appropriate.

If the inkjet head 100 includes just one nozzle array, the shift register 120 may sequentially connect all the respective latch circuits.

In some examples, the printer 200 may cause the inkjet head 100 to move (rather than convey the paper P past the inkjet head 100) to form an image on a medium.

The inkjet head 100 may be a recirculation type inkjet head which flows ink through the inkjet head from a storage volume and then returns ink to the storage volume.

In the head drive circuit configured as described above, the configuration of the shift register 120 can be set so that the array data for each nozzle array can be stored according to the total number of nozzle arrays (the number of arrays) provided in the inkjet head. As a result, the configuration of the head drive circuit can be changed according to the number of arrays. Therefore, the head drive circuit can be used with any number of arrays.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A control circuit for an inkjet head, the control circuit comprising:

an input circuit configured to receive drive information for driving liquid ejection from a plurality of nozzle arrays, the drive information including a drive signal value to be supplied to a channel of the plurality of nozzle arrays;

a latch circuit array comprising a plurality of latch circuits for storing the drive information for each array in the plurality of nozzle arrays; and a setting register configured to receive a setting value to configure the input circuit to correspond to a connection mode for the plurality of latch circuits, the setting value corresponding to the number of arrays in the plurality of nozzle arrays, wherein each latch circuit includes a plurality of input terminals, each input terminal of the latch circuit corresponding to a predetermined number of arrays in the plurality of nozzle arrays.

2. The control circuit according to claim 1, wherein the latch circuit array comprises eight latch circuits, and each latch circuit includes a first input terminal and a second input terminal.

3. The control circuit according to claim 1, wherein when the setting value received by the setting register indicates a first connection mode, the (2n−1)th latch circuits in the plurality of latch circuits are connected to each other and the (2n)th latch circuits in the plurality of latch circuits are connected to each other, where n is an integer of 1 or more.

4. The control circuit according to claim 1, wherein when the setting value received by the setting register indicates a second connection mode, the (4n−3)th latch circuits in the plurality of latch circuits are connected to each other, the (4n−2)th latch circuits in the plurality of latch circuits are connected to each other, the (4n−1)th latch circuits in the plurality of latch circuits are connected to each other, and the (4n)th latch circuits in the plurality of latch circuits are connected to each other, where n is an integer of 1 or more.

5. The control circuit according to claim 1, wherein the input circuit comprises:

a first counter configured to count array data in the received drive information and, when activated, to output, in sequence, a first enable signal to a first AND circuit and a second enable signal to a second AND circuit, and a second counter configured to count array data in the received drive information and, when activated, to output, in sequence, a first enable signal to a third AND circuit, a second enable signal to a fourth AND circuit, a third enable signal to a fifth AND circuit, and fourth enable signal to a sixth AND circuit, and the setting register is configured to activate one of the first and second counters based on the received setting value.

6. The control circuit according to claim 5, wherein a first latch circuit in the plurality of latch circuits has a first input terminal connected to an output terminal of the first AND circuit and a second input terminal connected to an output terminal of the third AND circuit, a second latch circuit in the plurality of latch circuit has a first input terminal connected to an output terminal of the second AND circuit and a second input terminal connect to an output terminal of the fourth AND circuit, a third latch circuit in the plurality of latch circuits has a first input terminal connected to an output terminal of the first latch circuit and a second input terminal connected to an output terminal of the fifth AND circuit, and a fourth latch circuit in the plurality of latch circuits has a first input terminal connected to an output terminal of the second latch circuit and a second input terminal connected to an output terminal of the sixth AND circuit.

7. An inkjet head, comprising:

a plurality of nozzle arrays including a plurality of nozzles that discharge a liquid; and a control circuit including:

an input circuit configured to receive drive information for driving liquid ejection from the plurality of nozzle arrays, the drive information including a drive signal value to be supplied to a channel of the plurality of nozzle arrays, a latch circuit array comprising a plurality of latch circuits for storing the drive information for each array in the plurality of nozzle arrays, and a setting register configured to receive a setting value to configure the input circuit to correspond to a connection mode for the plurality of latch circuits, the setting value corresponding to the number of arrays in the plurality of arrays, wherein each latch circuit includes a plurality of input terminals, each input terminal of the latch circuit corresponding to a predetermined number of arrays in the plurality of nozzle arrays.

8. The inkjet head according to claim 7, wherein the latch circuit array comprises eight latch circuits, and each latch circuit includes a first input terminal and a second input terminal.

9. The inkjet head according to claim 7, wherein when the setting value received by the setting register indicates a first connection mode, the (2n−1)th latch circuits in the plurality of latch circuits are connected to each other and the (2n)th latch circuits in the plurality of latch circuits are connected to each other, where n is an integer of 1 or more.

10. The inkjet head according to claim 7, wherein when the setting value received by the setting register indicates a second connection mode, the (4n−3)th latch circuits in the plurality of latch circuits are connected to each other, the (4n−2)th latch circuits in the plurality of latch circuits are connected to each other, the (4n−1)th latch circuits in the plurality of latch circuits are connected to each other, and the (4n)th latch circuits in the plurality of latch circuits are connected to each other, where n is an integer of 1 or more.

11. The inkjet head according to claim 7, wherein the input circuit comprises:

a first counter configured to count array data in the received drive information and, when activated, to output, in sequence, a first enable signal to a first AND circuit and a second enable signal to a second AND circuit, and a second counter configured to count array data in the received drive information and, when activated, to output, in sequence, a first enable signal to a third AND circuit, a second enable signal to a fourth AND circuit, a third enable signal to a fifth AND circuit, and fourth enable signal to a sixth AND circuit, and the setting register is configured to activate one of the first and second counters based on the received setting value.

12. The inkjet head according to claim 11, wherein a first latch circuit in the plurality of latch circuits has a first input terminal connected to an output terminal of the first AND circuit and a second input terminal connected to an output terminal of the third AND circuit, a second latch circuit in the plurality of latch circuit has a first input terminal connected to an output terminal of the second AND circuit and a second input terminal connect to an output terminal of the fourth AND circuit, a third latch circuit in the plurality of latch circuits has a first input terminal connected to an output terminal of the first latch circuit and a second input terminal connected to an output terminal of the fifth AND circuit, and a fourth latch circuit in the plurality of latch circuits has a first input terminal connected to an output terminal of the second latch circuit and a second input terminal connected to an output terminal of the sixth AND circuit.

13. A printer, comprising;

a print head with a plurality of nozzle arrays including a plurality of nozzles; and a control circuit including:

an input circuit configured to receive drive information for driving liquid ejection from the plurality of nozzle arrays, the drive information including a drive signal value to be supplied to a channel of the plurality of nozzle arrays, a latch circuit array comprising a plurality of latch circuits for storing the drive information for each array in the plurality of nozzle arrays, and a setting register configured to receive a setting value to configure the input circuit to correspond to a connection mode for the plurality of latch circuits, the setting value corresponding to the number of arrays in the plurality of arrays, wherein each latch circuit includes a plurality of input terminals, each input terminal of the latch circuit corresponding to a predetermined number of arrays in the plurality of nozzle arrays.

14. The printer according to claim 13, wherein when the setting value received by the setting register indicates a first connection mode, the (2n−1)th latch circuits in the plurality of latch circuits are connected to each other and the (2n)th latch circuits in the plurality of latch circuits are connected to each other, where n is an integer of 1 or more.

15. The printer according to claim 13, wherein when the setting value received by the setting register indicates a second connection mode, the (4n−3)th latch circuits in the plurality of latch circuits are connected to each other, the (4n−2)th latch circuits in the plurality of latch circuits are connected to each other, the (4n−1)th latch circuits in the plurality of latch circuits are connected to each other, and the (4n)th latch circuits in the plurality of latch circuits are connected to each other, where n is an integer of 1 or more.

16. The printer according to claim 13, wherein the input circuit comprises:

a first counter configured to count array data in the received drive information and, when activated, to output, in sequence, a first enable signal to a first AND circuit and a second enable signal to a second AND circuit, and a second counter configured to count array data in the received drive information and, when activated, to output, in sequence, a first enable signal to a third AND circuit, a second enable signal to a fourth AND circuit, a third enable signal to a fifth AND circuit, and fourth enable signal to a sixth AND circuit, and the setting register is configured to activate one of the first and second counters based on the received setting value.

17. The printer according to claim 16, wherein a first latch circuit in the plurality of latch circuits has a first input terminal connected to an output terminal of the first AND circuit and a second input terminal connected to an output terminal of the third AND circuit, a second latch circuit in the plurality of latch circuit has a first input terminal connected to an output terminal of the second AND circuit and a second input terminal connect to an output terminal of the fourth AND circuit, a third latch circuit in the plurality of latch circuits has a first input terminal connected to an output terminal of the first latch circuit and a second input terminal connected to an output terminal of the fifth AND circuit, and a fourth latch circuit in the plurality of latch circuits has a first input terminal connected to an output terminal of the second latch circuit and a second input terminal connected to an output terminal of the sixth AND circuit.

* * * * *